US005127848A

United States Patent [19]

Taguchi

[11] Patent Number: 5,127,848

[45] Date of Patent: Jul. 7, 1992

[54] CONNECTOR ENGAGEMENT DETECTING APPARATUS

[75] Inventor: Naoto Taguchi, Shizuoka, Japan

[73] Assignee: Yazaki Corporation, Tokyo, Japan

[21] Appl. No.: 672,293

[22] Filed: Mar. 20, 1991

[30] Foreign Application Priority Data

Mar. 23, 1990 [JP] Japan ..... 2-72062

[51] Int. Cl.[5] ..... H01R 3/00

[52] U.S. Cl. ..... 439/489; 439/188

[58] Field of Search ..... 439/188, 488, 489, 490, 439/350, 357; 200/51 R, 51.09, 51.1

[56] References Cited

U.S. PATENT DOCUMENTS 4,750,893 6/1988 Sueyoshi et al. ..... 439/596
4,878,853 11/1989 Yamade et al. ..... 439/144
4,900,267 2/1990 Nagasaka et al. ..... 439/488
4,915,649 4/1990 Shimazu et al. ..... 439/489 X

*Primary Examiner*—Larry I. Schwartz
*Assistant Examiner*—Khiem Nguyen
*Attorney, Agent, or Firm*—Armstrong, Nikaido, Marmelstein, Kubovcik & Murray

[57] ABSTRACT

A first connector housing has a resilient lock arm and a second connector housing to be connected with the first connector housing has an engagement projection and a short-circuit contact behind the engagement projection. The engagement projection cooperates with the resilient lock arm when the two connector housings are joined together. The first connector housing also has a pair of elastic contacts situated on either side of the resilient lock arm which are connected at the rear with a connector engagement detection circuit. The front ends of the paired elastic contacts are rested on the front end of the resilient lock arm so that the elastic contacts are displaced by the tilting motion of the lock arm. The resilient lock arm has a lock bar at the front end that abuts on and is guided along a guide surface of the engagement projection so that the lock arm is tilted or deflected when the two connector housings are being engaged. When the two connector housings are completely connected, the lock bar rides over and beyond the engagement projection and the resilient lock arm snaps back to its original shape, allowing the front ends of the paired elastic contacts to come into contact with the short-circuit contact, thus completing a connector engagement detection circuit.

4 Claims, 4 Drawing Sheets

CONNECTOR ENGAGEMENT DETECTING APPARATUS

BACKGROUND OF THE INVENTION

1. Field of the Invention

The present invention relates to a connector engagement detecting apparatus which has a means to determine whether or not a pair of mating connectors used for connection of automotive wiring harnesses are normally joined together.

2. Prior Art

Referring to FIGS. 4 and 5, one of mating connector housings a is formed with a contact accommodating chamber d in which a pair of electric contacts b, c are inserted in non-contacting condition. The other mating connector housing e has a drive piece f, formed as a resilient cantilever, whose free end $f_1$ forces the lower contact c upward into contact with the upper contact b. The connector housing a also has an interfering projection g in front of the electric contact c, which, when the paired connector housings fail to be connected normally, abuts against the free end $f_1$ of the drive piece f, deflecting it to block the electric contacts b, c from coming into forced contact with each other. When the mating connector housings are completely connected together, the interfering projection g is received into a recess $f_2$ allowing the drive piece f to move from a position indicated by a broken line in FIG. 5*b* to a position of a solid line, which in turn causes the contact c to engage with the contact to complete a detection circuit.

In the above-mentioned prior art, since the dedicated chamber d for accommodating the detecting electric contacts b, c is necessary, the connector housing becomes complex in shape, making the resin molding process correspondingly more difficult. Moreover, the drive piece f made of resin material may undergo thermal deformation from ambient heat generated during service. In that case, the driving force acting on the electric contact c decreases, degrading the reliability of electric conduction through the electric contacts b and c.

SUMMARY OF THE INVENTION

The present invention has been accomplished to overcome the above drawbacks and its objective is to provide a connector engagement detecting apparatus which requires no dedicated chamber for accommodating the detection contacts, which can simplify the shape of the connector housing and which maintains a high reliability of electric conduction through the detecting contacts.

To achieve the above objective, a connector engagement detecting apparatus of this invention comprises: a first connector housing and a second connector housing, said first and second connector housing being adapted to be joined together; a resilient lock arm provided to the first connector housing; an engagement portion provided to the second connector housing to cooperate with said resilient lock arm; a pair of elastic contacts provided to the first connector housing for detecting the correct engagement between the first and second connector housings; and a short-circuit contact provided to the second connector housing; whereby free ends of the paired elastic contacts are displaced as the resilient lock arm is tilted and, when the mating connector housings are connected completely, come into contact with the short-circuit contact on the second connector housing.

PREFERRED EMBODIMENT OF THE INVENTION

Figure 1:
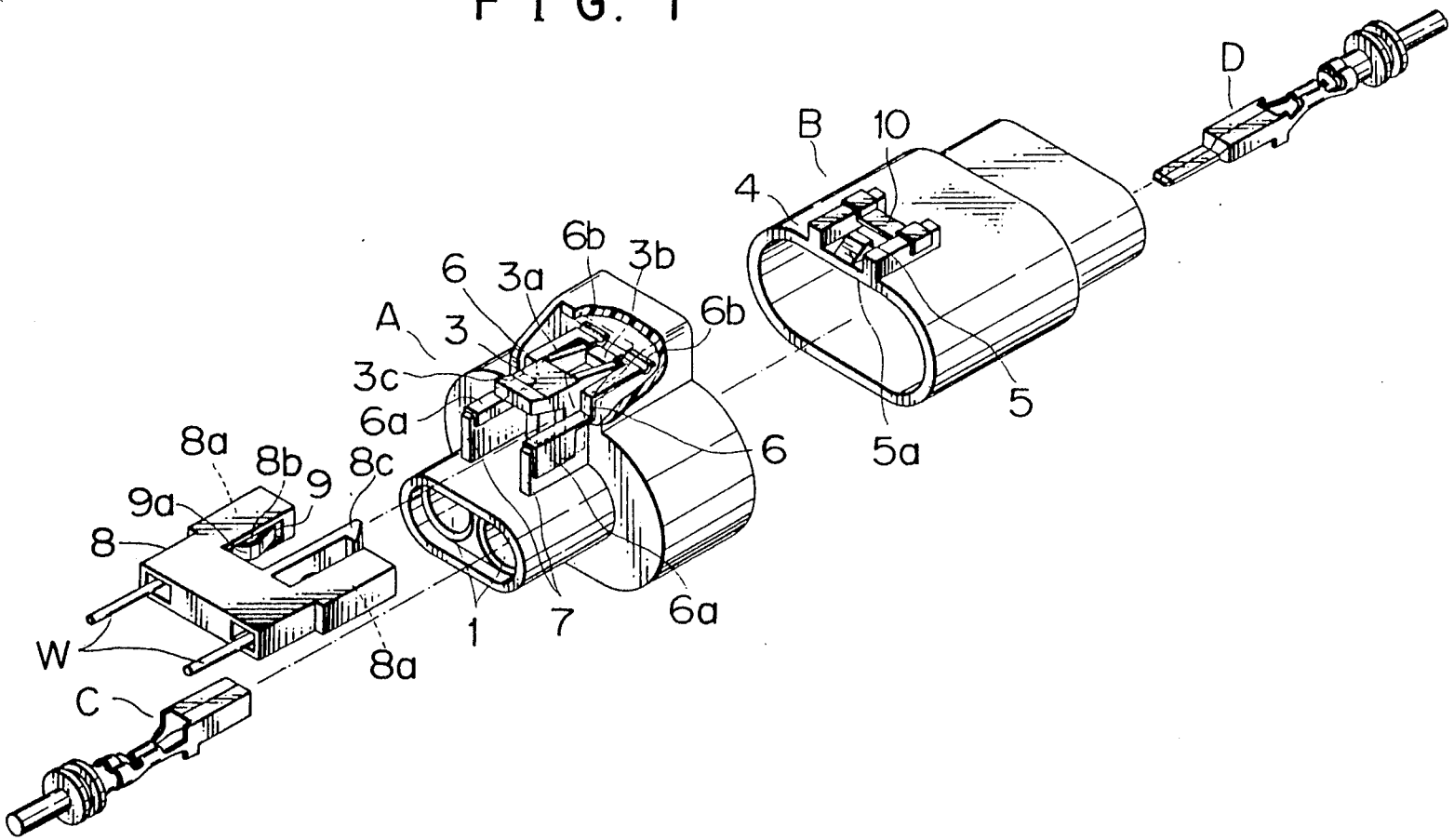
FIG. 1 is an exploded perspective view of one embodiment of this invention.
Figure 2:
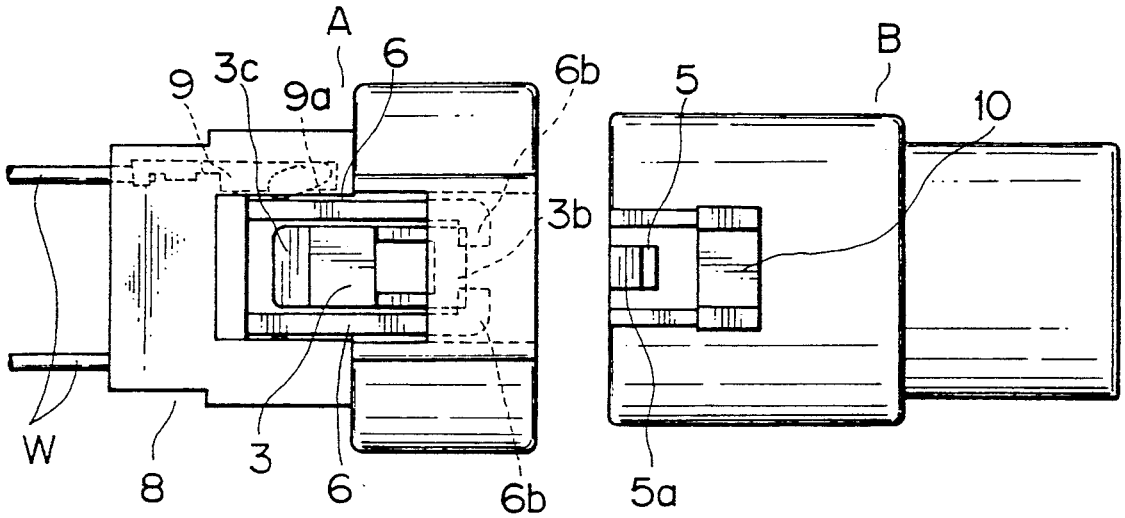
FIG. 2 is a plan view of the embodiment with the paired connector housings separated.
Figure 4:
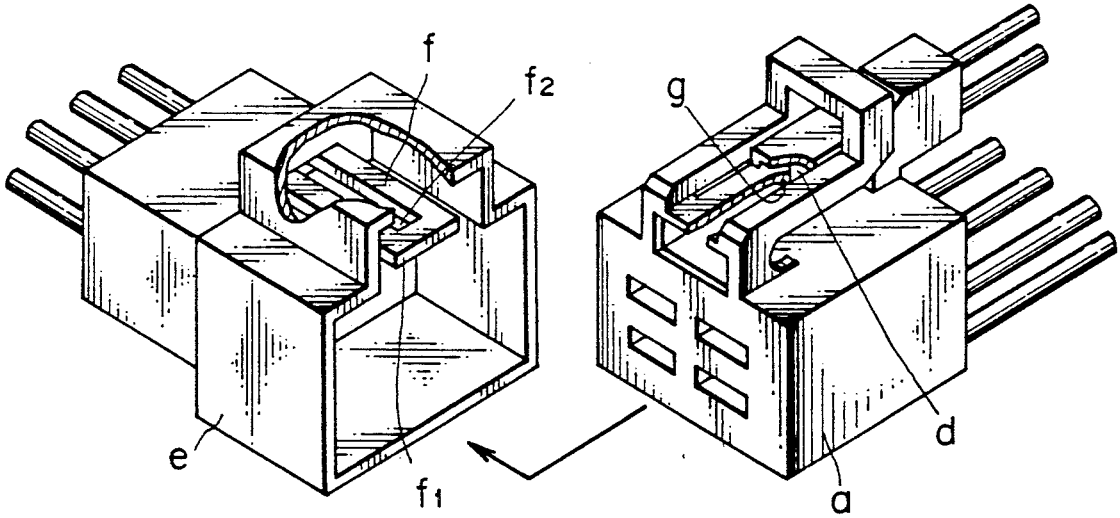
FIG. 4 PRIOR ART
FIG. 4 is a perspective view of a prior art shown partly cut away.
Figure 3A:
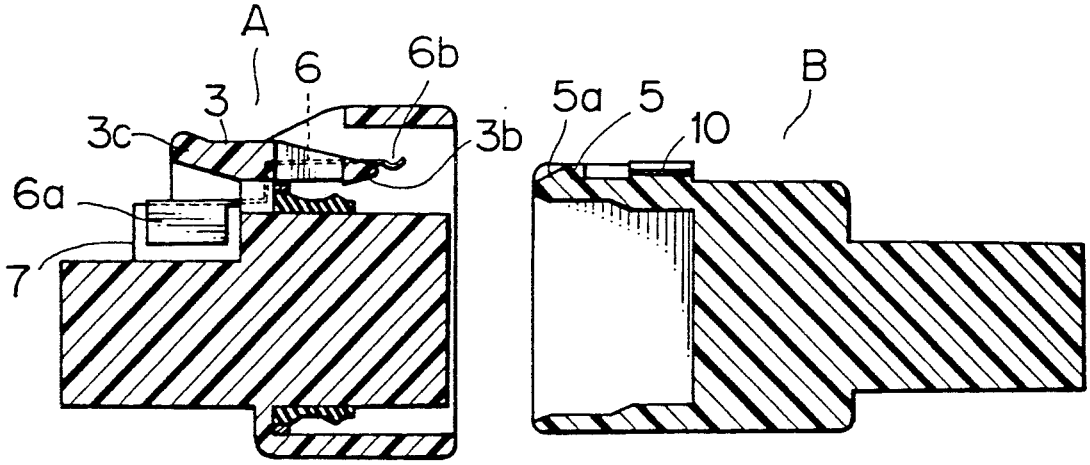
FIGS. 3*a* and 3*b* are vertical cross sections of the embodiment, with FIG. 3*a* showing the mating connector housings disconnected, FIG. 3*b* showing them incompletely connected, and FIG. 3*c* showing them completely connected.
Figure 3B:
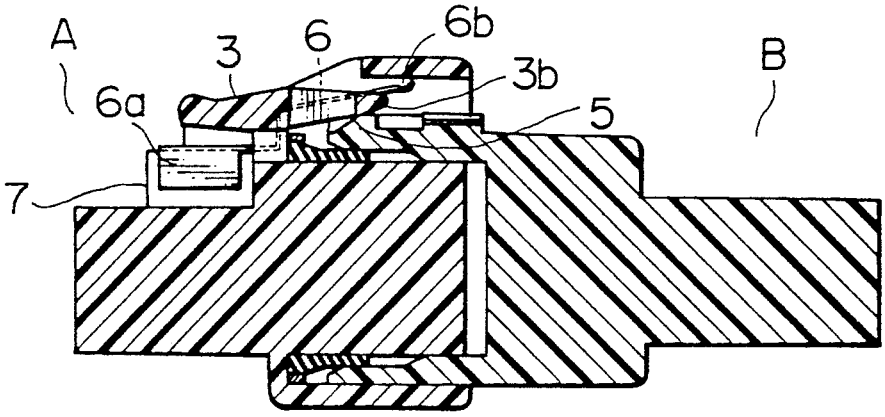
Figure 3C:
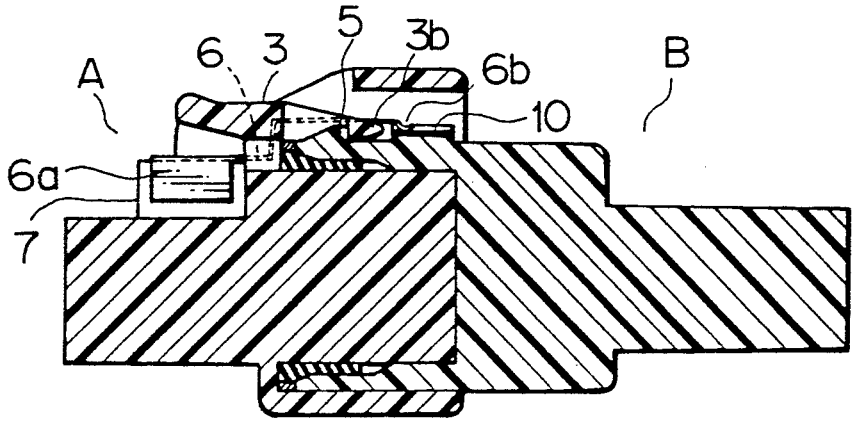
Figure 5A:
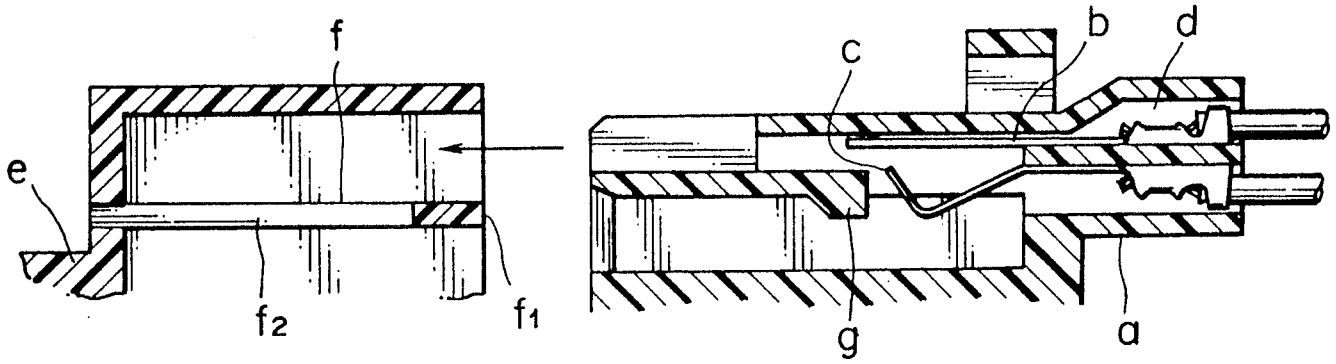
FIG. 5a PRIOR ART
FIGS. 5*a* and 5*b* are cross sections of essential portions of FIG. 4, with FIG. 5*a* showing the mating connector housings disconnected and FIG. 5*b* showing them connected.
Figure 5B:
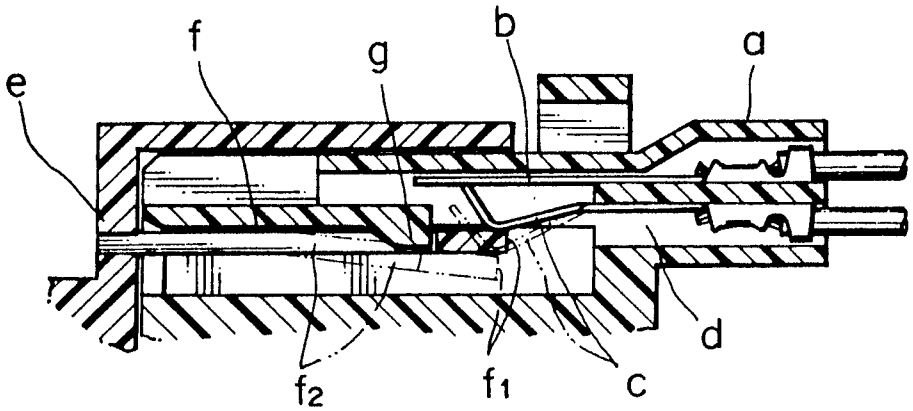
FIG. 5b PRIOR ART

Referring to FIGS. 1 through 3, denoted A is a male connector housing, and B a female connector housing, both made of synthetic resin material.

The male connector housing A, as is known, is formed with a plurality of terminal accommodating chambers 1 in which female terminal lugs C are inserted and fixed. The female connector housing B also has a plurality of terminal accommodating chambers (not shown) in which male terminal lugs D are inserted and fixed.

On the upper surface 2 of the male connector housing A, a longitudinally extending resilient lock arm 3 is provided which has a resilient vertical support 3*a* at the middle portion thereof. The resilient lock arm 3 has a lock bar 3*b* at the front end and an unlock press portion 3*c* at the rear end.

The female connector housing B has at the front end of an upper surface 4 thereof an engagement projection 5 for engagement with the lock bar 3*b* of the resilient lock arm 3.

The connector engagement detecting apparatus with the above-mentioned construction acts as follows. When the male and female connector housings A, B are fitted together, the female and male terminal lugs C, D are brought into contact with each other. At the same time, as the lock bar 3*b* of the resilient lock arm 3 rides over a tapered guide surface 5*a* of the engagement projection 5, the resilient lock arm 3 is tilted upward and the lock bar 3*b* rides over the engagement portion 5, at which time the resilient lock arm 3 snaps back into its original shape, thus locking the male and female connector housings in the completely connected condition. The resilient lock arm 3 may be of a cantilever type, that is, it may have an erected support at one end so that the lock arm as a whole exhibits resiliency.

Designated 6 are elastic contacts for detecting the correct connector engagement, each of which has a stationary contact plate 6*a* and a contact end 6*b*. The stationary contact plate 6*a* is attached and bonded to support walls 7 situated on either side of the resilient lock arm 3. The elastic contacts 6 for connector engagement detection extend forward along the sides of the resilient lock arm 3 to the contact end 6*b* at the front, which projects forwardly from the upper part of the lock bar 3*b*.

Denoted 8 is a connector housing for the detection circuit, which is formed almost like a letter U. The connector housing 8 has a pair of terminal accommodating chambers 8*a* in which terminal lugs 9 for the detection circuit, connected beforehand with wires W, are installed. The terminal lugs 9 have their resilient contact pieces 9*a* projected inwardly of the connector housing 8. The connector housing 8 for the detection circuit has its terminal accommodating chambers 8*a* situated on the outside of the support walls 7. When the connector housing 8 engages with the support walls 7, a resilient lock piece 8*c* engages with an engagement portion formed on the inner side of one of the support walls 7. In this locked condition the resilient contact pieces 9*a* of the detection circuit terminal lugs 9 firmly engage with the stationary contact plates 6*a* of the engagement detection contacts 6. On the rear side of the engagement projection 5 of the female connector housing B is provided a short-circuit contact 10 that faces the ends 6*b* of the engagement detection elastic contacts 6.

In the above construction, when the connection between the male and female connector housings A, B is not complete, the lock bar 3*b* at the front of the resilient lock arm 3 rides over the engagement projection 5, causing the lock arm 3 to tilt upwardly, as shown in FIG. 3*b*. As a result, the elastic contact ends 6*b* of the engagement detection contacts 6 are also displaced upwardly.

When the male and female connector housings A, B are connected completely, the lock bar 3*b* rides over and beyond the engagement projection 5 and snaps back into engagement with it. At the same time, the elastic contact ends 6*b* by their own recovering force returns to the original shape, coming into contact with the short-circuit contact 10. Now, the engagement detection circuit is completed through the two engagement detection elastic contacts 6, the two terminal lugs 9, and the short-circuit contact 10.

The construction and advantages of this invention may be summarized as follows.

The connector engagement detecting apparatus of this invention consists of a connector housing with a resilient lock arm and a mating connector housing with an engagement projection that cooperates with the resilient lock arm. The first connector housing is provided with a pair of elastic contacts for detecting the correct connector engagement. The paired elastic contacts are deflected as the resilient lock arm is tilted. When the mating connector housings are connected completely, the ends of the paired elastic contacts are brought into contact with a short-circuit contact mounted on the second connector housing. This structure allows the engagement detection elastic contacts and the short-circuit contact to be incorporated into the connector housings without complicating the construction of the connector housings. Further, a stable contact force obtained between the elastic contacts and the short-circuit contact ensures a reliable electric conduction through these contacts.

What is claimed is:

1. A connector engagement detecting apparatus comprising:

a first connector housing and a second connector housing, said first and second connector housing being adapted to be joined together;

a resilient lock arm provided to the first connector housing;

an engagement portion provided to the second connector housing to cooperate with said resilient lock arm;

a pair of elastic contacts provided on said first connector housing for detecting correct engagement between said first and second connector housings; and a short-circuit contact plate provided on an outer surface portion of said second connector housing, free ends of said paired elastic contacts being formed so as to be displaced away from said short-circuit contact plate as said resilient lock arm is deflected and, when said connector housings are connected completely, to come into contact with said short-circuit contact plate on said second connector housing, wherein said paired elastic contacts have front ends rested on an upper surface of a front end of the resilient lock arm such that said paired elastic contacts for engagement detection are displaced by said resilient lock arm as said resilient lock arm is tilted or deflected, and that when said first and second connector housings are connected completely and said paired elastic contacts are released from deflecting force from said lock arm, said paired elastic contacts return to original shape by elastic recovering force to engage with said short-circuit contact plate.

2. A connector engagement detecting apparatus as claimed in claim 1, wherein said paired elastic contacts for detecting the correct engagement between said first and second connector housing have stationary contact plates secured to said first connector housing, and a connector housing for a detection circuit is connected to said first connector housing to bring into contact with the stationary contact plates of said paired elastic contacts a pair of engagement detection terminal lugs incorporated in the detection circuit connector housing.

3. A connector engagement detecting apparatus comprising:

a first connector housing and a second connector housing, said first and second connector housing being adapted to be joined together;

a resilient lock arm provided to the first connector housing;

an engagement portion provided to the second connector housing to cooperate with said resilient lock arm;

a pair of elastic contacts provided on said first connector housing for detecting correct engagement between said first and second connector housings; and a short-circuit contact plate provided on an outer surface portion of said second connector housing, free ends of said paired elastic contacts being formed so as to be displaced away from said short-circuit contact plate as said resilient lock arm is deflected and, when said connector housings are connected completely, to come into contact with said short-circuit contact plate on said second connector housing wherein said paired elastic contacts have front end engaged with a front end of said resilient lock arm so that said paired elastic contacts for engagement detection are displaced by said resilient lock arm as said resilient lock arm is tilted or deflected, and that when said first and second connector housings are connected completely, said paired elastic contacts return to original shape by a recovering force of said paired elastic contacts and a force of a resilient lock arm so as to engage with said short-circuit contact plate.

4. A connector engagement detecting apparatus as claimed in claim 3, wherein said paired elastic contacts for detecting the correct engagement between said first and second connector housing have stationary contact plates secured to said first connector housing, and a connector housing for a detection circuit is connected to said first connector housing to bring into contact with the stationary contact plates of said paired elastic contacts a pair of engagement detection terminal lugs incorporated in the detection circuit connector housing.

* * * * *